US008978205B2

(12) United States Patent
Kim

(10) Patent No.: US 8,978,205 B2
(45) Date of Patent: Mar. 17, 2015

(54) SAFETY COVER FOR A HINGE

(75) Inventor: Byeong Gil Kim, Gyeonggi-do (KR)

(73) Assignee: Byeong Gil Kim, Gyeonggi-Do (KR)

( * ) Notice: Subject to any disclaimer, the term of this patent is extended or adjusted under 35 U.S.C. 154(b) by 0 days.

(21) Appl. No.: 14/009,530

(22) PCT Filed: Apr. 10, 2012

(86) PCT No.: PCT/KR2012/002725

§ 371 (c)(1),
(2), (4) Date: Oct. 3, 2013

(87) PCT Pub. No.: WO2012/141479

PCT Pub. Date: Oct. 18, 2012

(65) Prior Publication Data

US 2014/0026361 A1 Jan. 30, 2014

(30) Foreign Application Priority Data

Apr. 12, 2011 (KR) ..... 10-2011-0033914

(51) Int. Cl.
*E05D 11/00* (2006.01)

(52) U.S. Cl.
CPC ..... *E05D 11/0054* (2013.01); *E05Y 2900/20* (2013.01); *E05Y 2201/11* (2013.01)
USPC ..... 16/251; 16/252

(58) Field of Classification Search
USPC ..... 16/242, 250, 251, 252, 255, 257, 285, 16/295, 308, 387
See application file for complete search history.

(56) References Cited

U.S. PATENT DOCUMENTS

| | | | | |
|---|---|---|---|---|
| 5,056,192 | A * | 10/1991 | Grass | 16/251 |
| 6,317,925 | B1 * | 11/2001 | Pietryga et al. | 16/250 |
| 6,557,210 | B2 * | 5/2003 | Kincaid | 16/250 |
| 6,637,073 | B2 | 10/2003 | Kincaid | |

FOREIGN PATENT DOCUMENTS

| | | |
|---|---|---|
| JP | 2007-516370 | 6/2007 |
| JP | 2010-225546 | 10/2010 |
| KR | 10-2001-0051836 | 6/2001 |
| KR | 10-2008-0007525 | 1/2008 |

* cited by examiner

*Primary Examiner* — Roberta Delisle
(74) *Attorney, Agent, or Firm* — Mark M. Friedman

(57) ABSTRACT

The present invention relates a hinge safety cover and, more particularly, a hinge safety cover in which a hinge installed between a door frame and a door of furniture or a sink, a cabinet, etc. used in a kitchen, is prevented from being exposed to the outside, thereby preventing clothes/bedclothes or a hanger being caught in the hinge so that the clothes/bedclothes are not damaged or the hinge is not broken, or preventing an accident which may cause a part of the body of a person, such as a finger, etc., to be trapped and injured.

10 Claims, 14 Drawing Sheets

SAFETY COVER FOR A HINGE

TECHNICAL FIELD

The present invention relates to a hinge safety cover and, more particularly, a hinge safety cover in which a hinge installed between a door frame and a door of furniture or a sink, a cabinet, etc. used in a kitchen, is prevented from being exposed to the outside, thereby preventing clothes/bedclothes or a hanger being caught in the hinge so that the clothes/bedclothes are not damaged or the hinge is not broken, or preventing an accident which may cause a part of the body of a person, such as a finger, etc., to be trapped and injured.

BACKGROUND ART

In general, hinges are metal products which are used when hanging a door/window by fixing one of hinge mounting plates to a door frame/window frame and fixing the other to a door/window. These hinges are mounted on the hinged doors/windows in furniture, such as a wardrobe storing clothes/bedclothes, or a cabinet, sink, etc. used in a kitchen.

This kind of a hinge comprises two mounting plates connected to each other by a hinge pin positioned in the center thereof. One mounting plate is fixed in upper positions of the inner surfaces of a door frame/window frame and a door/window to be opened/closed by a fixing bolt. The other mounting plate is fixed in lower positions thereof by another fixing bolt, so that the door/window is opened and closed. When this hinge is fixed to the door/window and the door frame/window frame by the mounting plates, as the door/window pivots to be opened, a gap widens in the corner of the door/window and the door frame/window frame where the hinge is fixed. If the door/window is fully opened, the gap in the corner of the door/window and the door frame/window frame gets to again narrow.

If the clothes/bedclothes as stored are caught in the gap widened in the corner between the door frame/window frame and the door/window, the door/window is not opened/closed. If worse, the clothes/bedclothes are damaged.

Moreover, when a part of the body of a person, specifically, a finger, etc., is trapped in the gap widened in the corner between the door frame/window frame and the door/window, if the door/window is opened, an accident of injuring it occurs.

Especially, little kids would carelessly put their fingers in the corner of the door frame/window frame and the door/window. In that case, if the door/window is opened, they would be seriously injured.

To solve the aforementioned problems, there has been used a hinge which does not narrow but widens the gap in the corner between the door frame/window frame and the door/window when the door/window is opened. Such a hinge comprises a plurality of frames: a fixing frame and a protruding frame to be fixed to the door frame/window frame, and a hinge frame to be installed to the door/window, to pivot with the door/window.

When the door/window is closed, the frames overlap around the hinge. However, when the door/window is opened, as the fixing frame and the hinge frame are spaced apart around the hinge, a gap is formed between the frames.

When opening/closing the door/window, the clothes on a hanger as stored in the wardrobe or furniture are likely to be caught in the gap between the fixing frame and the protruding frame of the hinge and/or the protruding frame and the hinge frame of the hinge. In that case, the door/window is not closed or, if worse, the clothes are damaged.

Moreover, if the clothes made of thin materials, such as blouses or dress shirts, are damaged, these may have to be discarded.

Additionally, when a hanger made of the materials, such as synthetic resins or metals, is caught in the gap between the frames of the hinge, if the door/window is opened/closed by force, the hinge is damaged and needs to be replaced.

In the wardrobe storing the bedclothes as well as the clothes, if the bedclothes are caught in the gap of the hinge, these are also damaged, like the clothes.

If the door/window is opened/closed when a part of the body of a person, specifically, a finger, not the clothes or bedclothes, is trapped in the gap of the hinge, the finger is injured. If worse, it may cause an accident of fracturing the bone of the finger trapped in the gap of the hinge.

In addition, since the hinge is shown inside in the door frame/window frame and the door/window, it does not look good in appearance.

Further, the conventional hinge is not capable of preventing the door/window from being suddenly closed. Since the door/window is suddenly closed, an unnecessary noise occurs. If the door/window is fast closed, it would cause an accident.

Therefore, a method has been really needed to prevent clothes/bedclothes or a part of the body of a person from being trapped in the gap(s) of the hinge.

DISCLOSURE

Technical Problem

Therefore, the present invention has been made to solve the above problems, and it is an object of the present invention to provide a hinge safety cover which prevents a hinge installed on a door/window of furniture or a sink/cabinet, etc. used in a kitchen from being exposed to the outside, thereby preventing clothes/bedclothes from being damaged or the hinge from being broken when the clothes/bedclothes or hangers are caught in the gap(s) of the hinge, and in advance preventing the occurrence of any accident that a part of the body of a person, specifically, fingers, is trapped in the gap(s) of the hinge.

It is another object of the present invention to provide a hinge safety cover which comprises a securing cover to be installed on a fixing frame and a protruding frame of the hinge fixed to a door frame/window frame, a pivoting cover to be pivotally connected to the securing cover by a hinge and which covers a hinge frame so as not to be exposed to the outside, the hinge frame pivoting at different angles of the door/window when it is opened/closed and pivoting and operating with the door/window, thereby preventing clothes/bedclothes from being caught between the frames of the hinge when the door/window is opened/closed.

It is another object of the present invention to provide a hinge safety cover in which a number of adjusting bolts connected to the fixing frame and the protruding frame are easily adjusted from the outside, without separating the securing cover from the fixing frame and the protruding frame.

It is another object of the present invention to provide a hinge safety cover in which a door damper supporting the door/window is installed at the securing cover, preventing the door/window from being suddenly closed against the door frame/window frame, preventing an unnecessary noise from occurring when it is suddenly closed, and in advance preventing any accident that may occur between the door/window and the door frame/window frame.

Technical Solution

In accordance with an embodiment of the present invention, there is provided a hinge safety cover comprising: a securing cover to be fixed on the outside of a fixing frame of a hinge fixed to a door frame, to prevent the fixing frame and a protruding frame fixed to the fixing frame from being exposed to the outside; a pivoting cover to be connected to one side of the securing cover, pivoting with a door as pivoted; and supporting springs each positioned between a top end of the securing cover and the pivoting cover and between a bottom end of the securing cover and the pivoting cover, one end of each of the supporting spring being supported to the securing cover and the other end thereof being supported to the pivoting cover, thereby supporting the pivoting cover to be secured to the door by elasticity. The securing cover comprises: a securing cover body including: protruding plates each inwardly protruding, vertically spaced apart to each other at a regular distance, a protruding frame receiving opening to receive the protruding frame of the hinge between the protruding plates, and securing protrusions protruding at upper and lower positions at both sides of each of the protruding plates so that the securing protrusions are connected to the protruding frame; cover plates each protruding at upper and lower positions of the securing cover body, thereby receiving the fixing frame of the hinge; a protruding part forwardly protruding of the securing cover body, at a right angle; and a catching protrusion protruding in a front end of the protruding part, thereby catching one side end of the pivoting cover.

The pivoting cover comprises: a pivoting cover body including hinge holes formed at upper and lower positions of the pivoting cover, a catching part being bent and inwardly protruding at one side end of the pivoting cover; a pivoting plate positioned at one side of the pivoting cover body, thereby preventing the hinge frame of the hinge fixed to the door from being exposed to the outside when the door pivots; sliding rollers vertically spaced apart to each other at a regular distance at one side of the pivoting plate so that the pivoting plate slides on the surface of the door and pivots; and spring supporting protrusions of which one inwardly and downwardly protrudes at one side of one of the hinge holes and the other inwardly and upwardly protrudes at one side of the other hinge hole, thereby supporting the supporting springs.

The securing cover further comprises: a first bolt adjusting hole, a second bolt adjusting hole and third bolt adjusting holes. The first bolt adjusting hole is penetrated at the center of the protruding part so that the first bolt adjusting hole is operatively connected to the protruding frame receiving opening, thereby adjusting, from the outside, a first protruding frame adjusting bolt connected to the protruding frame of the hinge. The second bold adjusting hole is penetrated at one side of the securing cover body at a location parallel to a second protruding frame adjusting bolt, so that the second bold adjusting hole is operatively connected to the protruding frame receiving opening, thereby adjusting, from the outside, the second protruding frame adjusting bolt connected to one side of the protruding frame of the hinge. Each of the third bolt adjusting holes is penetrated at the center of each of the cover plates so that each of the third bolt adjusting holes is operatively connected to the inside of each of the cover plates, thereby adjusting, from the outside, each of the fixing frame adjusting bolts connected to the fixing frame of the hinge.

The securing cover further comprises: an opening/closing part to be inserted into the first bolt adjusting hole and to open/close the first bolt adjusting hole, and opening/closing stoppers to open/close the second bolt adjusting hole and the third bolt adjusting holes.

The securing cover further comprises: a door damper including a supporting pin with its front end to support an inside of the door so that the open door pivots to be closed at a certain speed. The door damper may be inserted into one side of the protruding frame receiving opening of the securing cover body of the securing cover and the supporting pin protrudes towards the door.

The door damper may be inserted into one side of the cover plate of the securing cover and the supporting pin protrudes towards the door.

Advantageous Effects

As described above, the hinge safety cover according to the present invention prevents a hinge, which is installed on a door/window of furniture or a sink, cabinet, etc. used in a kitchen, from being exposed to the outside, thereby preventing clothes/bedclothes from being damaged or a hinge from being broken when the clothes/bedclothes or hanger are caught in a gap of the hinge. It also prevents the occurrence of any accident caused when a part of the body of a person, specifically, fingers, is trapped in a gap of the hinge.

Further, since the hinge safety cover comprises the securing cover to be secured to the hinge and the pivoting cover in the fan shape pivotally connected to the securing cover, it pivots at diverse angles of the door/window pivoting when the door/window is opened/closed. Therefore, it covers the hinge pivoting and operating with the door/window, thereby preventing clothes/bedclothes from being caught in the hinge when the door/window is opened/closed.

Furthermore, in the hinge safety cover, a number of adjusting bolts connected to the fixing frame and the protruding frame are easily adjusted from the outside, without separating the securing cover from the fixing frame and the protruding frame.

Additionally, in the hinge safety cover, since the door damper supporting the door/window is installed at the securing cover, the door/window is prevented from being suddenly closed against the door frame/window frame. Therefore, it prevents an unnecessary noise from occurring when it is suddenly closed and it prevents any accident that may occur between the door/window and the door frame/window frame.

DESCRIPTION OF DRAWINGS

These and other aspects and advantages of the present invention will become apparent and more readily appreciated from the following description of the embodiments, taken in conjunction with the accompanying drawings, in which.

BRIEF DESCRIPTION OF REFERENCE NUMBERS OF MAJOR ELEMENTS

Figure 1:
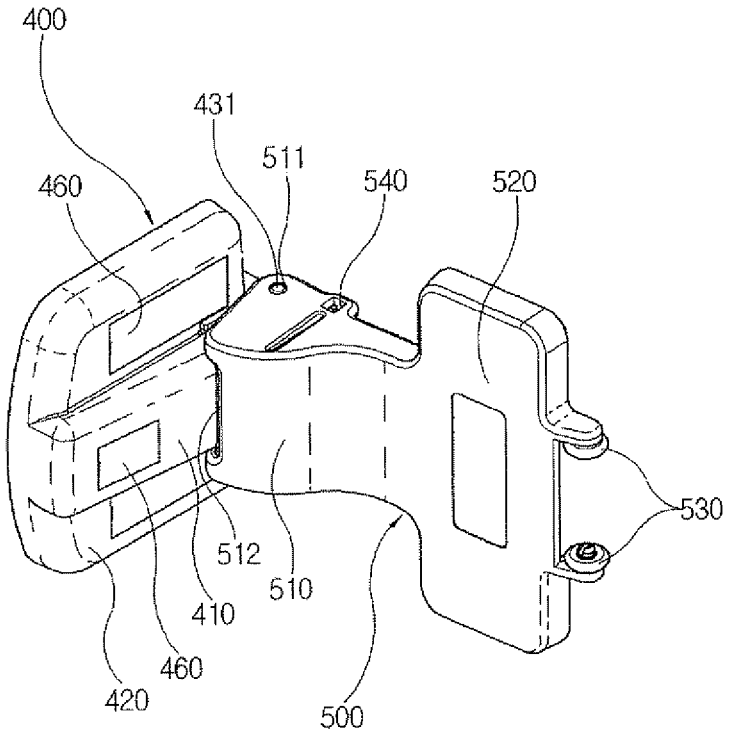
FIG. 1 is an example view of a hinge safety cover according to an embodiment of the present invention.
Figure 2:
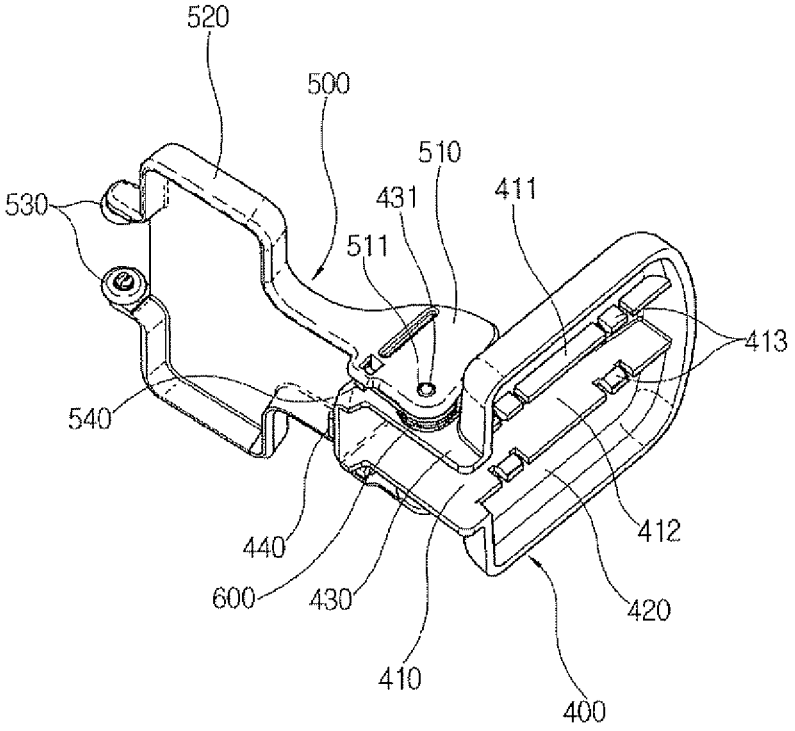
FIG. 2 is an example view of an inside of the hinge safety cover.
Figure 3:
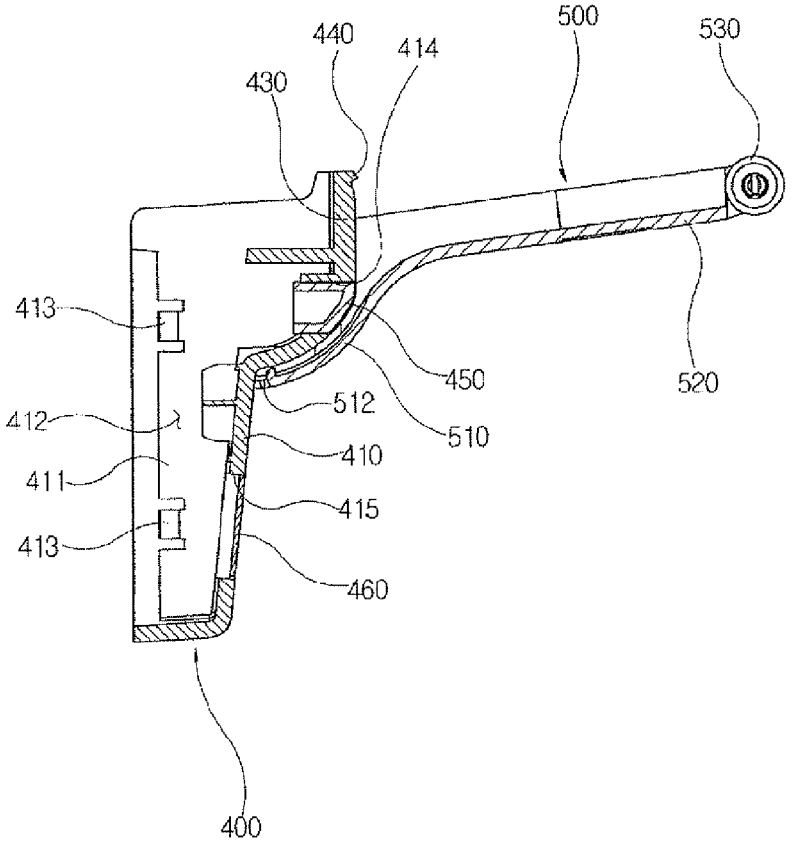
FIG. 3 is an example view of a cross-section of the hinge safety cover.
Figure 4:
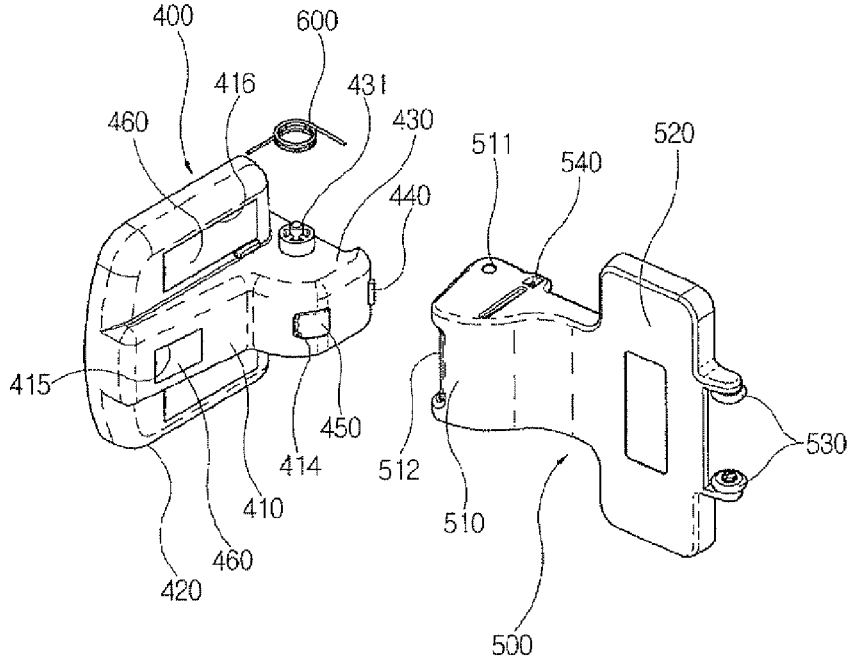
FIG. 4 is an example view of a securing cover and a pivoting cover separated from the hinge safety cover.

| | |
|---|---|
| 100: door frame | |
| 200: door | |
| 300: hinge | |
| 310: fixing frame | 311: fixing frame adjusting bolts |
| 320: protruding frame | 321: 1st protruding frame adjusting bolt |
| 322: 2nd protruding frame adjusting bolt | |
| 330: hinge frame | |
| 400: securing cover | |
| 410: securing cover body | 411: protruding plates |
| 412: protruding frame receiving opening | |
| 413: securing protrusions | |
| 414: 1st bolt adjusting hole | 415: 2nd bold adjusting hole |
| 416: 3rd bolt adjusting holes | 420: cover plates |
| 430: protruding part | 431: hinge protrusions |
| 440: catching protrusion | 450: opening/closing part |
| 460: opening/closing stoppers | |
| 500: pivoting cover | |
| 510: pivoting cover body | 511: hinge holes |
| 512: catching part | 520: pivoting plate |
| 530: sliding rollers | 540: spring supporting protrusions |
| 600: supporting springs | |
| 700: door damper | 710: supporting pin |

BEST MODE

Hereinafter, embodiments of the present invention will be described in detail with reference to the accompanying drawings.

As used herein, the singular forms "a", "an" and "the" are intended to include the plural forms as well, unless the context clearly indicates otherwise.

In FIGS. 1 through 4, a hinge safety cover comprises a securing cover 400, a pivoting cover 500 and supporting springs 600. The securing cover 400 is secured to the outside of a fixing frame of a hinge 300 fixed to a door frame 100 so that the fixing frame 310 and a protruding frame 320 to be connected to the fixing frame 310 are not exposed to the outside. The pivoting cover 500 is connected at one side of the securing cover 400 by a hinge so that it pivots together with a door 200 as pivoted. The supporting springs 600 are positioned between a top end of the securing cover 400 and the pivoting cover 500 and a bottom end of the securing cover 400 and the pivoting cover 500, respectively. One side of each of the supporting springs 600 is supported to the securing cover 400 and the other side thereof is supported to the pivoting cover 500, thereby supporting the pivoting cover 500 to be secured to the door 200 by elasticity.

The securing cover 400 comprises a securing cover body 410. The securing cover body 410 comprises protruding plates 411, a protruding frame receiving opening 412 and securing protrusions 413. The protruding plates 411 each inwardly protrude, vertically spaced apart to each other at a regular distance, inside the securing cover body 410. The protruding frame receiving opening 412 is formed so that the protruding frame 320 of the hinge 300 is inserted between the protruding plates 411. The securing protrusions 413 protrude at upper and lower positions at both sides of each of the protruding plates 411 so that the securing protrusions 413 are connected to the protruding frame 320, respectively.

The securing cover 400 further comprises cover plates 420, a protruding part 430 and a catching protrusion 440. The cover plates 420 are positioned at upper and lower positions of the securing cover body 410. The protruding part 430 forwardly protrudes at a right angle at one side of the securing cover body 410. The protruding part 430 includes hinge protrusions 431 each protruding at upper and lower positions of the protruding part 430. The catching protrusion 440 protrudes at a front end of the protruding part 430, thereby catching one side end of the pivoting cover 500.

The securing cover 400 further comprises a first bolt adjusting hole 414 and a second bolt adjusting hole 415. The first bolt adjusting hole 414 is penetrated at a center of the protruding part 430 so that it is operatively connected to the protruding frame receiving opening 412, thereby adjusting, from the outside, a first protruding frame adjusting bolt 321 connected to the protruding frame 320 of the hinge 300. The second bolt adjusting hole 415 is penetrated at one side of the securing cover body 410 at a position being parallel to a protruding frame adjusting bolt 322 so that it is operatively connected to the protruding frame receiving opening 412, thereby adjusting, from the outside, the second protruding frame adjusting bolt 322 connected to one side of the protruding frame 320 of the hinge 300.

The securing cover 400 further comprises third bolt adjusting holes 416. Each of the third bolt adjusting holes 416 is penetrated at a center of each of the cover plates 420 so that it is operatively connected to an inside of the cover plate 420, thereby adjusting, from the outside, each of fixing frame adjusting bolts 311 connected to the fixing frame 310 of the hinge 300. The securing cover 400 further comprises an opening/closing part 450 and opening/closing stoppers 460. The opening/closing part 450 is inserted into the first bolt adjusting hole 414, to open/close the first bolt adjusting hole 414. The opening/closing stoppers 460 open/close the second bolt adjusting hole 415 and the third bolt adjusting holes 416.

The pivoting cover body 510 comprises hinge holes 511 at upper and lower positions thereof and a catching part 512 bent and inwardly protruding at one side end thereof. The pivoting plate 520 is positioned at one side of the pivoting cover body 510, thereby preventing the hinge frame 330 of the hinge 300 fixed to the door 200 from being exposed to the outside when the door 200 pivots.

The pivoting cover 500 further comprises sliding rollers 530 and spring supporting protrusions 540. The sliding rollers 530 are vertically spaced apart to each other, at a regular distance, at one side end of the pivoting plate 520 so that the pivoting plate 520 slides to the surface of the door 200 and pivots. One of the spring supporting protrusions 540 inwardly and downwardly protrudes at one side of one of the hinge holes 511 of the pivoting cover body 510 and the other spring supporting protrusion 540 inwardly and upwardly protrudes at one side of the other hinge hole 511, thereby supporting one side end of each of the supporting springs 600.

Figure 5:
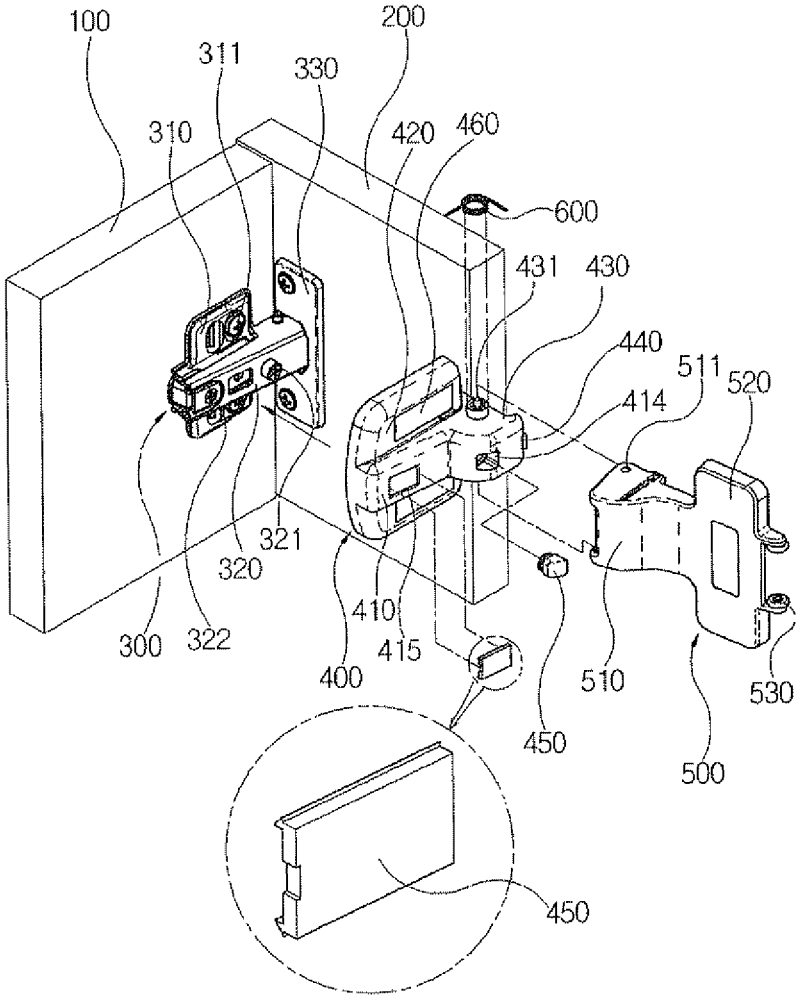
FIG. 5 is an example view of a state of installing the hinge safety cover at a hinge.

In the hinge safety cover shown in FIG. 5, the supporting springs 600 are respectively connected to the hinge protrusions 431 protruding at the upper and lower positions of the protruding part 430 of the securing cover 400. The hinge protrusions 431 are respectively connected to and inserted into the hinge holes 511 positioned at the upper and lower positions of the pivoting cover body 510 of the pivoting cover 500.

Figure 6:
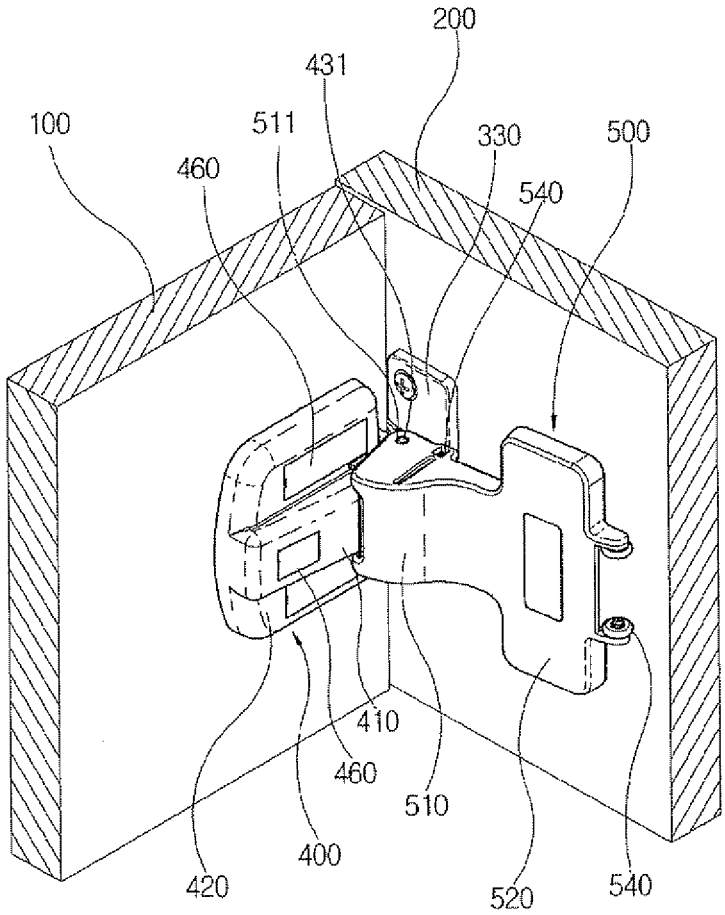
FIG. 6 is an example view of the state that the hinge safety cover has been installed at the hinge.
Figure 7:
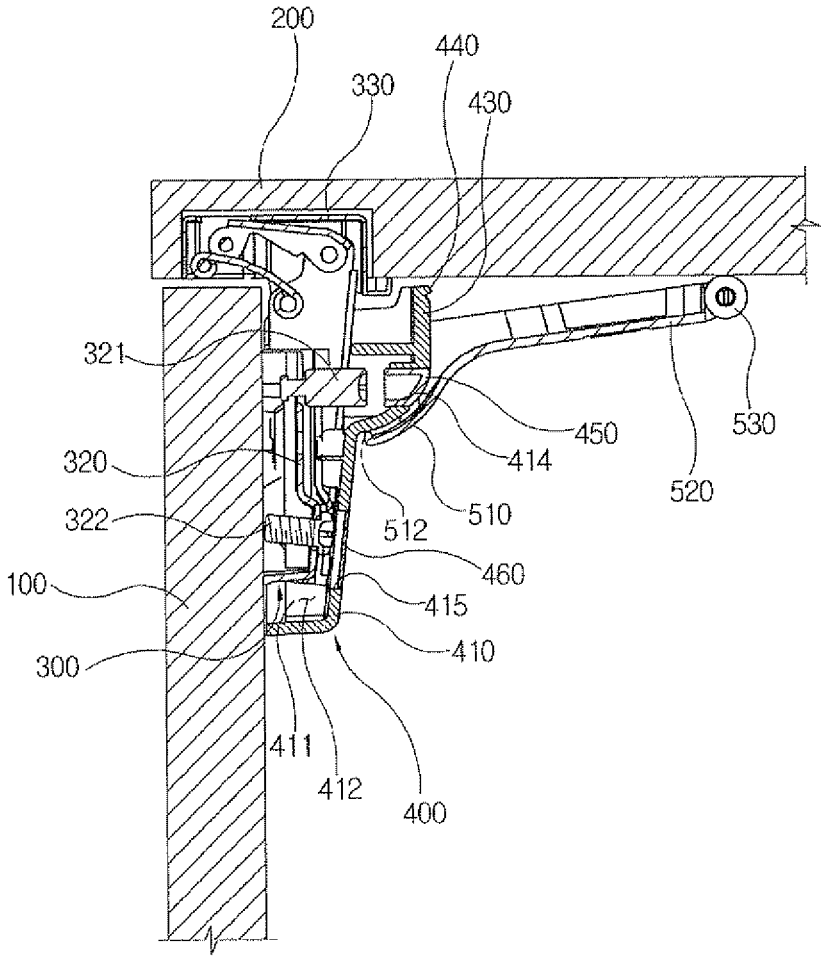
FIG. 7 is an example view of a central cross section of the hinge safety cover as installed at the hinge.

When the protruding frame 320 is connected to and inserted into the protruding frame receiving opening 412, a number of the securing protrusions 413 protruding at the lower and upper positions at the both sides of the protruding plates 411 are caught in an upper edge and an lower edge of the protruding frame 320 as shown in FIGS. 6 and 7. Then, the securing cover body 410 and the cover plates 420 are secured to the protruding frame 320 and therefore, the fixing frame 310 and the protruding frame 320 are fixed to the door frame 100 so as not to be exposed to the outside.

Figure 8:
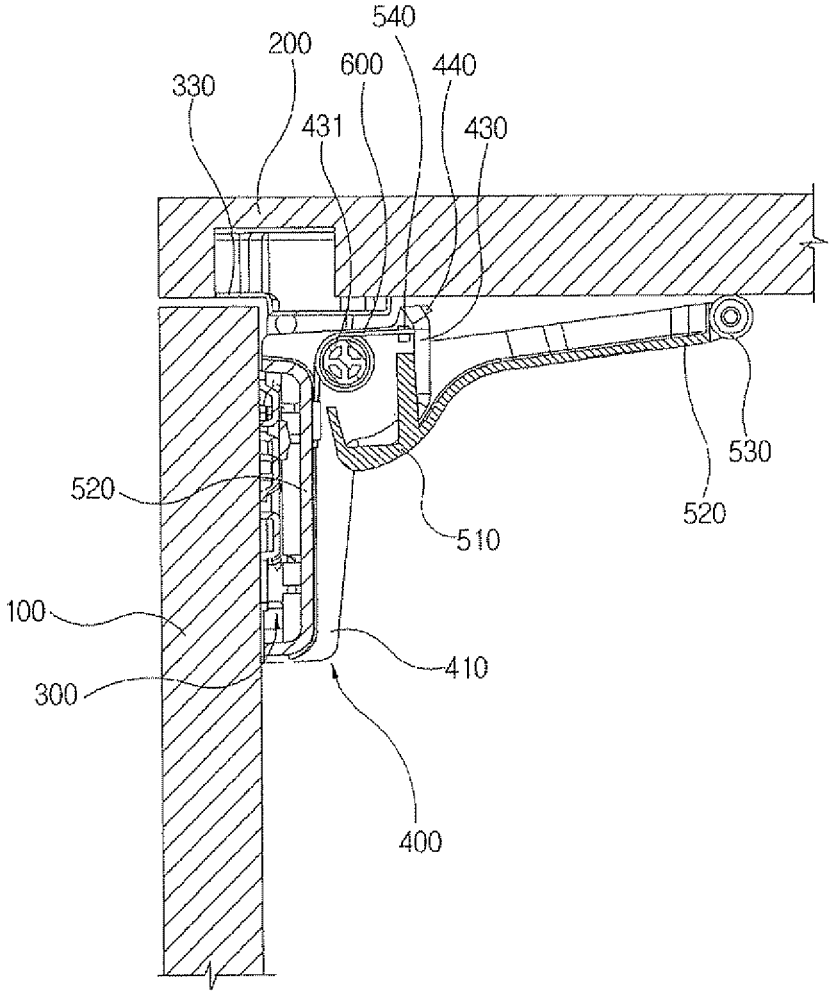
FIG. 8 is an example view of a top cross section of the hinge safety cover as installed at the hinge.

As shown in FIG. 8, one end of each of the supporting springs 600 which is connected to be supported to each of the hinge protrusions 431 between the protruding part 430 of the securing cover 400 and the pivoting cover body 510 of the pivoting cover 500, is supported to the front of each of the cover plates 420 provided at the upper and lower positions of the securing cover body 410 of the securing cover 400. The other end thereof is supported to each of the spring supporting protrusions 540 protruding at the upper and lower positions of the hinge holes 511 of the pivoting cover body 510 of the pivoting cover 500. Then, the pivoting cover body 510 and the pivoting plate 520 of the pivoting cover 500 are secured towards the door 200 by the elasticity.

MODE FOR INVENTION

Figure 9:
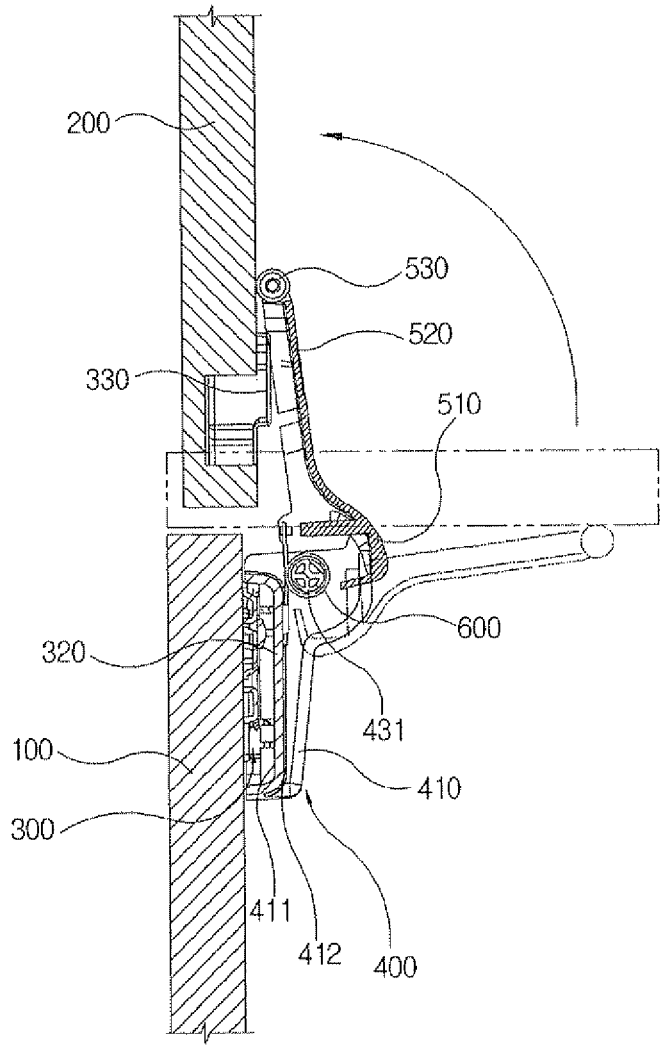
FIG. 9 is an example view of a door pivoting at a right angle after the hinge safety cover is installed at the hinge.

After the securing cover 400 is installed at the protruding frame 320 of the door frame 100, when the door 200 is opened from the door frame 100 at a right angle direction as shown in FIG. 9, the pivoting cover body 510 and the pivoting plate 520 of the pivoting cover 500 pivot in the same direction as the door 200 around the hinge protrusions 431 respectively protruding at the upper and lower positions of the protruding part 430 of the securing cover 400 connected to the hinge holes 511.

Then, in the pivoting cover 500 pivoting with the door 200, a plurality of the sliding rollers 530 at the end of the pivoting plate 520 rotate in a state of being secured to the surface of the door 200. Then, the pivoting plate 520 slides to the surface of the door 200, pivoting with the door 200 around the hinge protrusions 431 of the securing cover 400. Accordingly, no noise occurs and the pivoting cover 500 is capable of easily pivoting without scratching the inside surface of the door 200.

Figure 10:
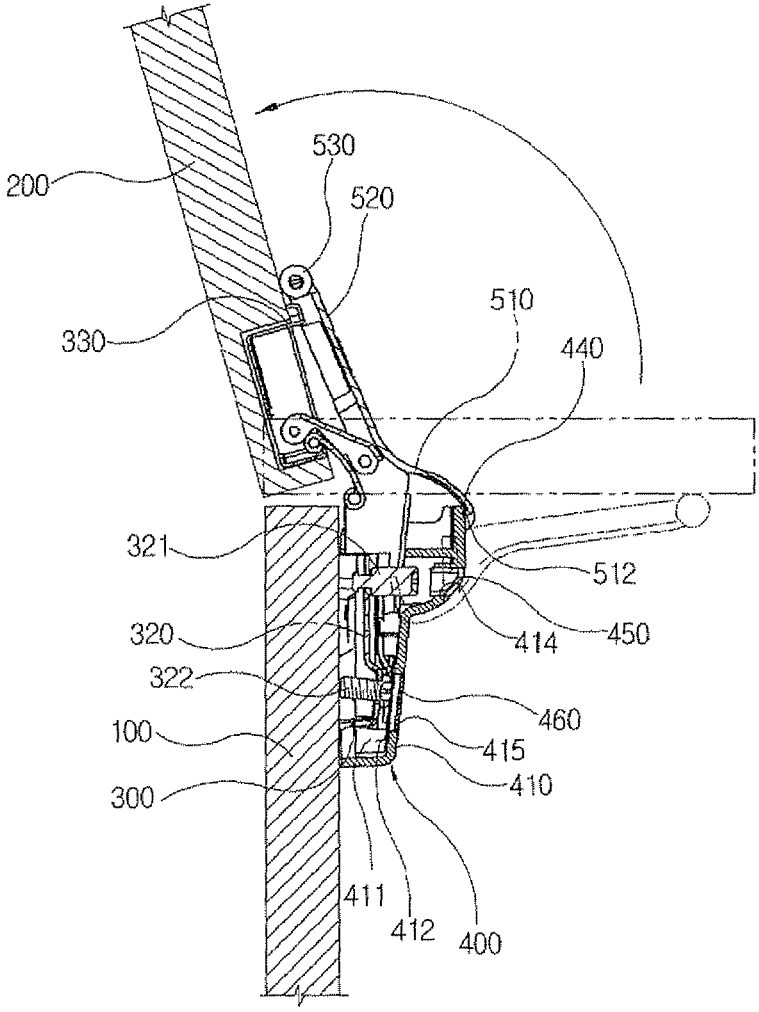
FIG. 10 is an example view of the door pivoting at a greater angle than the right angle after the hinge safety cover is installed at the hinge.

When the door 200 pivots to be opened at a greater angle than the right angle, as shown in FIG. 10, the pivoting cover 500 pivots with the door 200 so that the pivoting plate 520 covers the hinge frame 330 installed at the door 200 so as not to be exposed to the outside.

When the catching part 512 inwardly protruding at the one side end of the pivoting cover body 510 catches the catching protrusion 440 outwardly protruding at the one side end of the protruding part 430 of the securing cover 400, the pivoting cover body 510 and the pivoting plate 520 of the pivoting cover 500 do not pivot at a greater angle than a certain angle. This prevents clothes/bedclothes or a part of the body of a user from being caught or trapped in the gap between the protruding part 430 of the securing cover 400 and the pivoting cover body 510 of the pivoting cover 500 when the door 200 is excessively opened.

Figure 11:
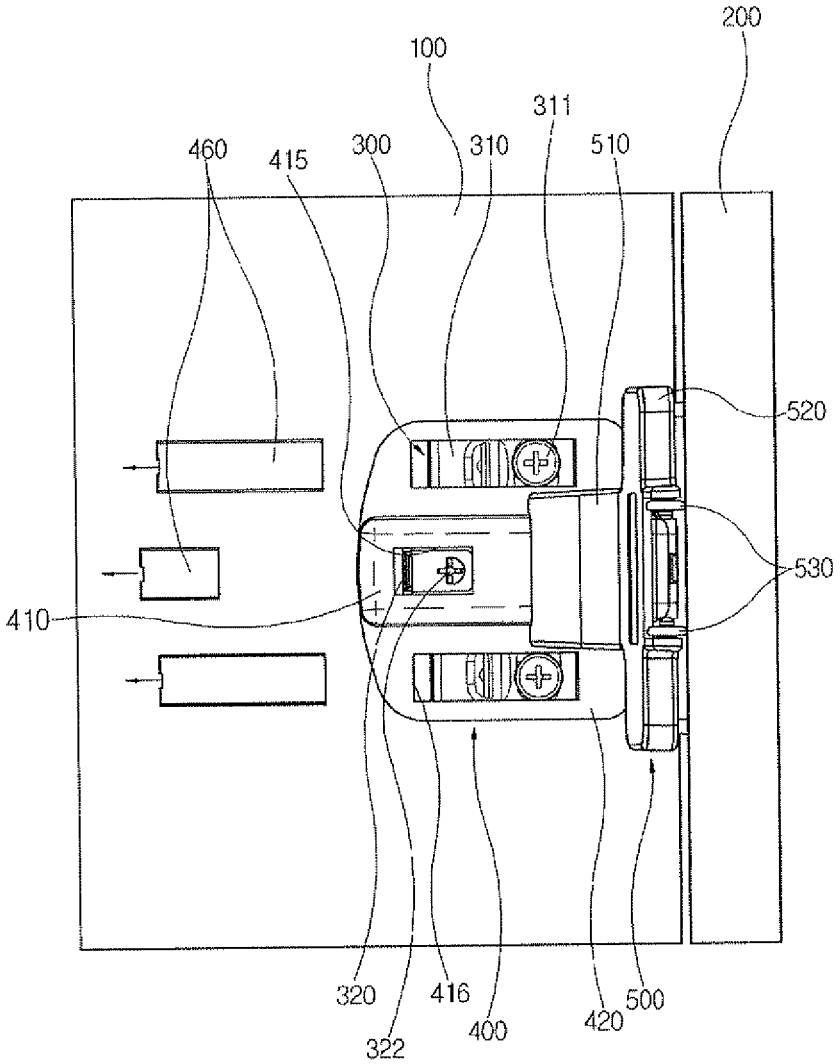
FIG. 11 is an example view of opening/closing stoppers separated from the securing cover of the hinge safety cover.

In the case of adjusting the fixing frame adjusting bolts 311 connected to the fixing frame 310 of the hinge 300 installed at the door frame 100 because it is not aligned in the position with the door frame 100 when opening/closing the door 200, each of the opening/closing stoppers 460 connected to the center of each of the cover plates 420 at the upper and lower positions of the securing cover body 410 of the securing cover 400 needs to be separated from each of the third bolt adjusting holes 416 as shown in FIG. 11. Then, the fixing frame adjusting bolts 311 of the fixing frame 310 of the hinge 300 are exposed through the third bolt adjusting holes 416, so that the fixing frame adjusting bolts 311 can be adjusted from the outside by using a proper tool.

In the case of adjusting the second protruding frame adjusting bolt 322 of the protruding frame 320 of the hinge 300, it is possible to easily adjust, from the outside, the second protruding frame adjusting bolt 322 by using a proper tool by separating the opening/closing stopper 460 connected to the second bolt adjusting hole 415 penetrated to be operatively connected to the protruding frame receiving opening 412 inside of the one side of the securing cover body 410.

In the case of adjusting the first protruding frame adjusting bolt 321 of the protruding frame 320, it needs to separate the opening/closing part 450 connected to the first bolt adjusting hole 414 in the front of the protruding part 430 of the securing cover 400 in the condition that the door 200 is opened as shown in FIG. 10 and to adjust the first protruding frame adjusting bolt 321 of the protruding frame 320 by using a tool like a driver.

As described above, in the hinge safety cover according to the present invention, it is possible to easily adjust, from the outside, the fixing frame adjusting bolts 311 and the first and second protruding frame adjusting bolts 321, 322, without separating the securing cover body 410 and the cover plates 420 of the securing cover 400 from the fixing frame 310 and the protruding frame 320 of the hinge 300.

Figure 12:
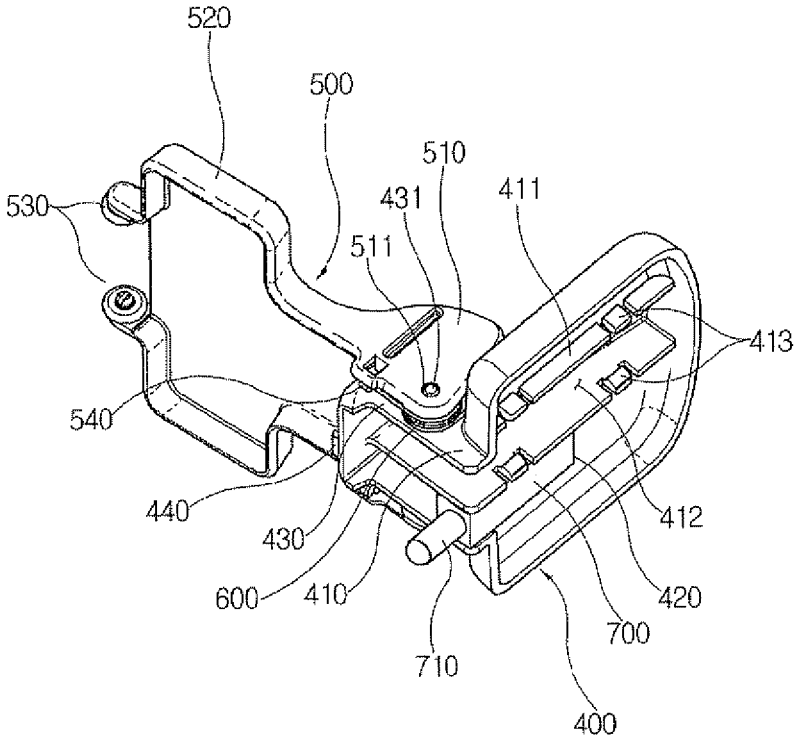
FIG. 12 is an example view of a hinge safety cover according to another embodiment of the present invention.
Figure 13:
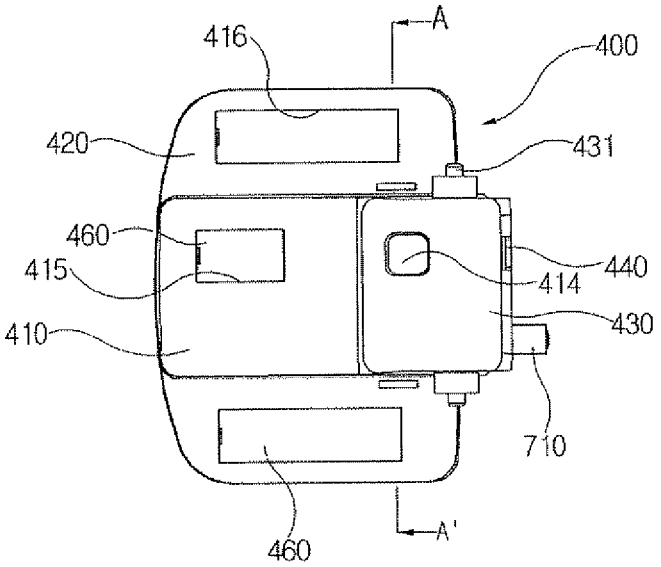
FIG. 13 is an example view of a front of a securing cover in the hinge safety cover of FIG. 12.
Figure 14:
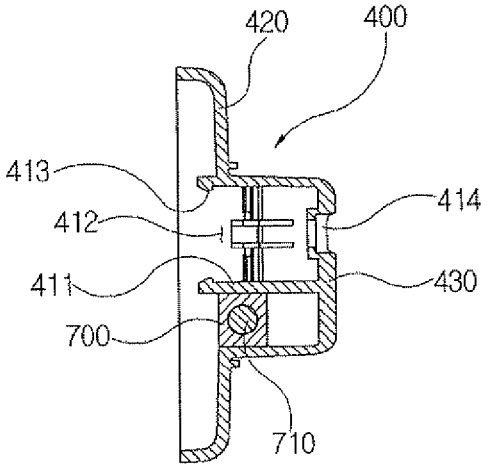
FIG. 14 is an example view of a cross-section taken along a Line A-A' in FIG. 13.

The securing cover 400 further comprises a door damper 700 including a supporting pin 710 with a front end supporting the inside of the door so that the open door 200 pivots to be closed at a certain speed, not to be suddenly closed, as shown in FIGS. 12 and 14. The door damper 700 is inserted into any of the upper and lower positions of the protruding frame receiving opening 412 of the securing cover body 410 of the securing cover 400 so that the supporting pin 710 protrudes towards the door 200.

In the drawings, the door damper 700 is illustrated as being installed at the lower position of the protruding frame receiving opening 412 of the securing cover body 410. However, the door damper 700 may be installed at the upper position of the protruding frame receiving opening 412 by preparing a space to receive it. Otherwise, the door dampers 700 may be installed at the upper and lower positions of the protruding frame receiving opening 412, respectively.

Figure 15:
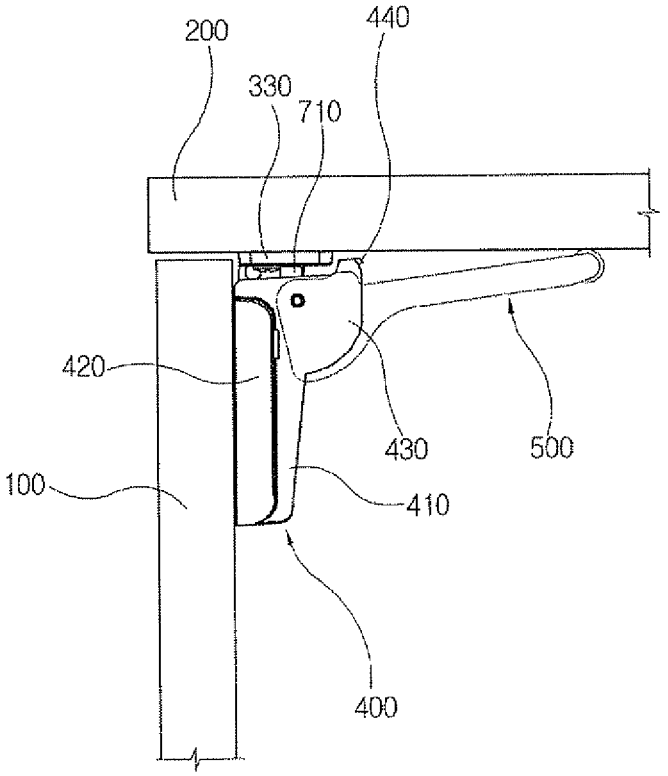
FIGS. 15, 16 and 17 are example views of states of a door pivoting in the hinge safety cover of FIG. 12.
Figure 16:
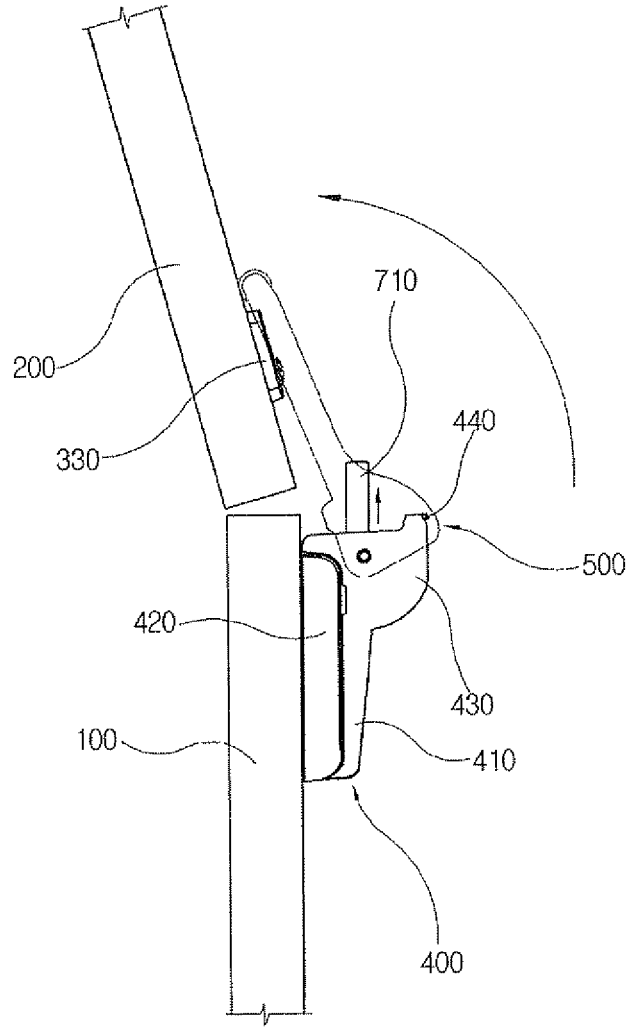
Figure 17:
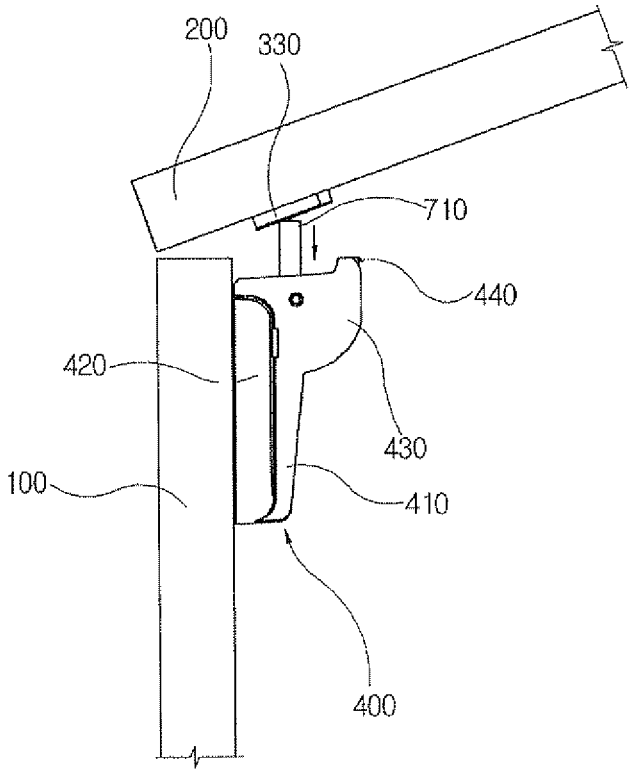

In the door damper 700 as shown in FIGS. 15 through 17, the supporting pin 710 inserted inside the door damper 700 protrudes toward the door 200 when the door 200 is opened. When the door 200 is closed by the hinge 300, the supporting pin 710 is slowly inserted inside the door damper 700 by supporting the inside of the door 200. Therefore, an accident is prevented by preventing the door from being suddenly closed.

Figure 18:
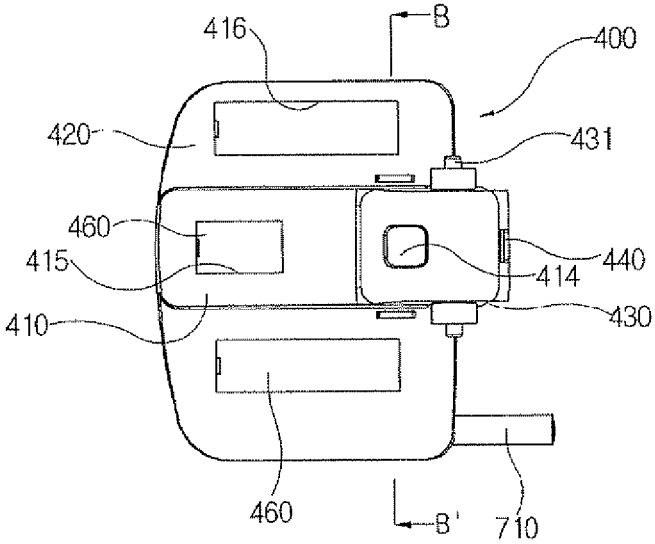
FIG. 18 is an example view of a hinge safety cover according to another embodiment of the present invention.
Figure 19:
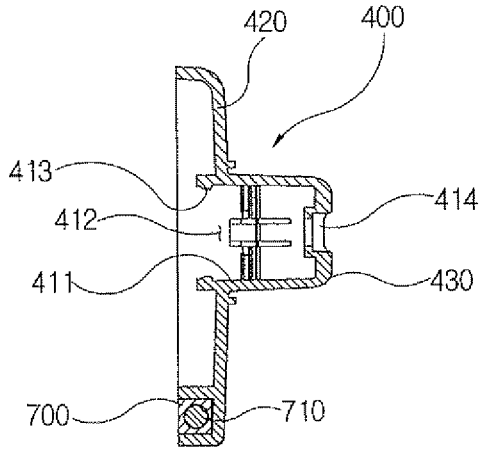
FIG. 19 is an example view of a cross-section taken along a Line B-B' in FIG. 18.

As shown in FIGS. 18 and 19, the door damper 700 may be positioned outside the cover plates 420 of the securing cover 400 in the manner that the supporting pin 710 protrudes towards the door 200. In the drawing, the door damper 700 is described as, for example, being installed by extending a lower part of the cover plate 420 positioned at the lower position of the securing cover body 410. However, the door damper 700 may be carried out by being installed at an upper position of the cover plate 420 by extending the upper part of the cover plate 420 positioned at the upper position of the securing cover body 410. When the door is made of the heavy materials, like metals, the cover plates 420 may be extended upwardly and downwardly in the securing cover body 410 so that the door dampers 700 are installed at the upper and lower positions of the cover plates 420, respectively, thereby preventing the heavy door from being suddenly closed.

The invention has been described using a preferred embodiment(s). However, it is to be understood that the scope of the invention is not limited to the disclosed embodiment(s). The scope of the claims, therefore, should be accorded the broadest interpretation so as to encompass all various modifications and similar arrangements within the capabilities of persons skilled in the art using presently known or future technologies and equivalents.

The invention claimed is:

1. A hinge safety cover comprising:

a securing cover to be fixed on the outside of a fixing frame of a hinge fixed to a door frame, to prevent the fixing frame and a protruding frame fixed to the fixing frame from being exposed to the outside;

a pivoting cover to be connected to one side of the securing cover, pivoting with a door as pivoted; and supporting springs each positioned between a top end of the securing cover and the pivoting cover and between a bottom end of the securing cover and the pivoting cover, one end of each of the supporting spring being supported to the securing cover and the other end thereof being supported to the pivoting cover, thereby supporting the pivoting cover to be secured to the door by elasticity;

wherein the securing cover comprises:

a securing cover body including: protruding plates each inwardly protruding, vertically spaced apart to each other at a regular distance, a protruding frame receiving opening to receive the protruding frame of the hinge between the protruding plates, and securing protrusions protruding at upper and lower positions at both sides of each of the protruding plates so that the securing protrusions are connected to the protruding frame;

cover plates each protruding at upper and lower positions of the securing cover body, thereby receiving the fixing frame of the hinge;

a protruding part forwardly protruding of the securing cover body, at a right angle; and a catching protrusion protruding in a front end of the protruding part, thereby catching one side end of the pivoting cover.

2. The hinge safety cover according to claim 1, wherein the pivoting cover comprises:

a pivoting cover body including hinge holes formed at upper and lower positions of the pivoting cover, a catching part being bent and inwardly protruding at one side end of the pivoting cover;

a pivoting plate positioned at one side of the pivoting cover body, thereby preventing the hinge frame of the hinge fixed to the door from being exposed to the outside when the door pivots;

sliding rollers vertically spaced apart to each other at a regular distance at one side of the pivoting plate so that the pivoting plate slides on the surface of the door and pivots; and spring supporting protrusions of which one inwardly and downwardly protrudes at one side of one of the hinge holes and the other inwardly and upwardly protrudes at one side of the other hinge hole, thereby supporting the supporting springs.

3. The hinge safety cover according to claim 1, wherein the securing cover (400) further comprises: a first bolt adjusting hole penetrated at the center of the protruding part so that the first bolt adjusting hole is operatively connected to the protruding frame receiving opening, thereby adjusting, from the outside, a first protruding frame adjusting bolt connected to the protruding frame of the hinge.

4. The hinge safety cover according to claim 3, wherein the securing cover further comprises: an opening/closing part to be inserted into the first bolt adjusting hole and to open/close the first bolt adjusting hole.

5. The hinge safety cover according to claim 1, wherein the securing cover further comprises: a second bold adjusting hole penetrated at one side of the securing cover body at a location parallel to a second protruding frame adjusting bolt, so that the second bold adjusting hole is operatively connected to the protruding frame receiving opening, thereby adjusting, from the outside, the second protruding frame adjusting bolt connected to one side of the protruding frame of the hinge.

6. The hinge safety cover according to claim 5, wherein the securing cover further comprises: opening/closing stoppers to open/close the second bolt adjusting hole and the third bolt adjusting holes.

7. The hinge safety cover according to claim 1, wherein the securing cover further comprises: third bolt adjusting holes each penetrated at the center of each of the cover plates so that each of the third bolt adjusting holes is operatively connected to the inside of each of the cover plates, thereby adjusting, from the outside, each of the fixing frame adjusting bolts connected to the fixing frame of the hinge.

8. The hinge safety cover according to claim 1, wherein the securing cover (400) further comprises: a door damper (700) including a supporting pin (710) with a front end to support an inside of the door (200) so that the open door (200) pivots to be closed at a certain speed.

9. The hinge safety cover according to claim 8, wherein the door damper (700) is inserted into one side of the protruding frame receiving opening (412) of the securing cover body (410) of the securing cover (400) so that the the supporting pin (710) protrudes towards the door (200).

10. The hinge safety cover according to claim 8, wherein the door damper (700) is inserted into one side of the cover plate (420) of the securing cover (400) so that the supporting pin (710) protrudes towards the door (200).

* * * * *